US006237523B1

(12) United States Patent
Day et al.

(10) Patent No.: US 6,237,523 B1
(45) Date of Patent: May 29, 2001

(54) STAIR DEVICE

(76) Inventors: Roger P. Day, Box 1065, Kemah, TX (US) 77565; John Maurice Nixon, P.O. Box 200564, Arlington, TX (US) 76006

( * ) Notice: Subject to any disclaimer, the term of this patent is extended or adjusted under 35 U.S.C. 154(b) by 0 days.

(21) Appl. No.: 09/511,175

(22) Filed: Feb. 22, 2000

(51) Int. Cl.[7] ..... B63B 17/00
(52) U.S. Cl. ..... 114/362; 182/86
(58) Field of Search ..... 114/362; 182/127, 182/86, 90, 91, 100

(56) References Cited

U.S. PATENT DOCUMENTS 4,726,317 * 2/1988 Ritten et al. ..... 114/362
4,768,618 * 9/1988 Ritten ..... 182/86

* cited by examiner

*Primary Examiner*—Ed Swinehart
(74) *Attorney, Agent, or Firm*—Valerie Friedrich

(57) ABSTRACT

A stair device for use in entering and exiting the water from a water vehicle, swim platform or dock. A first embodiment of the stair device is best suited for use on water vehicles and is comprised of an upper tubular section having two parallel tubes each having a straight vertical section, a curved section and a substantially straight horizontal section. A lower tubular section is rotatably mounted to the upper tubular section and is comprised of a single tube having a substantially straight upper portion, a curved portion, and a substantially straight lower portion. A plurality of steps is provided along the lower tubular portion. A second embodiment of the invention is best suited for use on horizontal structures, such as swim platforms and is comprised of an upper tubular portion having two parallel, horizontal tubes and a lower tubular section comprised of a single tube having a substantially straight upper portion, a curved portion, and a substantially straight lower portion.

2 Claims, 5 Drawing Sheets

STAIR DEVICE

BACKGROUND OF THE INVENTION

The present invention relates to a stair device for use in egress from and/or ingress to aquatic environments, such as on boats or at marinas. The stair device of the present invention is easily deployable and storable and may be stored in situ. More particularly, the present invention relates to a stair device which attaches to the hull, transom or swim platform of a boat or to a dock, deploys into the water and stores above the water line. In particular, the stair device of the present invention permits a person in the water to exit the water in an upright position, similar to the body position maintained while climbing stairs, and using primarily or solely the person's lower body strength and little or no upper body strength.

Several devices have been previously patented and/or marketed to assist people immersed in a body of water to exit the water and to climb onto a boat, other water vehicle or dock. For example, a common device used by boaters consists of a simple, flexible ladder comprised of two vertical rails made of a flexible materials, such as cotton or nylon rope and plastic or wood rungs suspended horizontally between such rails. Such ladders are inexpensive and easily deployed and do not require significant space for storage. Such ladders, however, are difficult to use as they require a person to possess sufficient upper body strength to initially pull themselves out of the water and up the ladder. Those without sufficient upper body strength or those carrying a load, such as scuba equipment, often find it impossible to independently exit the water using such ladders. Further complicating the use of such flexible ladders is their tendency to move while in use, thereby requiring additional strength and balance to exit the water.

A further disadvantage of prior art devices such as the flexible ladder is the difficulty of use with fins, waders or other footwear. Prior art devices in which the rungs or steps are bordered on one or both sides by a support or rail require an individual wearing aquatic footwear to carefully place their feet so that the footwear fits between the rails and through the rungs. Such careful maneuvering further complicates egress from the water. There is a need, therefore, for a stair device which may be easily used by an individual wearing footwear such as fins.

A number of ladder and/or platform devices have been previously patented and/or marketed to address the difficulty of climbing such a flexible ladder. For example, U.S. Pat. No. 4,768,618 (the '618 patent) provides a boat ladder device which provides fixed steps which do not move or swing while in use. The ladder of the '618 patent, however is quite bulky and must be disconnected from the boat transom for storage. Consequently, when not in use, the ladder of the '618 patent must occupy valuable and scarce storage space on the boat. U.S. Pat. No. 4,719,872 (the '872 patent) similarly describes a boat ladder which remains rigid while in use. However, the boat ladder of the '872 patent also requires that it be removed and stored when not in use. Other devices, such as that of U.S. Pat. No. 5,887,540 (the '540 patent), also provides easier access to a boat. However, because of the bulk and weight of the devices of the '618, '872 and '540 patents, such devices cannot be used in smaller watercraft, such as jet skis, dinghies, and compact power boats, which have recently become very popular. There is a need, therefore, for a stair device for use with watercraft which is sturdy but lighter in weight and which is not bulky so that it can remain in place at all times.

Because the prior art devices must be stored when not in use, these devices cannot be deployed by one already in the water. In an event of accidental disembarkation, one cannot use such prior art devices to re-embark on the boat. Therefore, there is a need for a boat stair device which would permit one to enter a boat from the water without prior intentional preparation and deployment of a stair device. Such an improvement would increase the safety of boating and other water sports activities utilizing watercraft.

The devices of each of the '618 and '872 patents provide a graduated vertical step permitting greater use of lower body strength and an easier climb than possible with a vertical ladder configuration. Nevertheless, because each of the ladders of the '618 and '872 patents must be stored when not in use, the size and number of steps which can be accommodated is limited. Therefore, the ladders of the '618 and '872 patents cannot be practically extended to extend significantly below the water line to a depth at which a person's feet may be easily positioned.

The American Boat and Yacht Council standard on boat ladders requires that boat ladder devices extend at least twelve inches below the waterline. The feet of a person in the water, however, generally rest at a depth substantially greater than the twelve inch standard. One using such prior art devices must generally hypercontract their leg, bringing their knee close in to their chest in to place a foot on the first rung of the device. Therefore, there is a need for a boat stair device which would permit an individual with limited flexibility and/or range of motion to simply step on a rung of the device at or near the position at which the individual's foot naturally rests in the water.

SUMMARY OF THE INVENTION

The stair device of the present invention addresses the deficiencies of the prior art devices by providing a device with an angle of assent which permits individuals of limited upper body strength to easily exit the water by use of lower body strength. The device of the present invention may also be used by individuals with limited flexibility and/or range of motion because the device of the present invention provides a step at or near the position at a greater depth than afforded by prior art devices. The device of the present invention is further preferable over prior art devices because its construction provides these advantages but yet is relatively light in weight and does not occupy a significant amount of space. Finally, because the device of the present invention provides unobstructed lateral access from either side at its lower portion, individuals wearing swim fins, waders or boots may also easily use the device.

A first embodiment of the present invention provides a stair device comprised of upper and lower tubular sections pivotally attached at the lower section of the upper tubular portion and the upper section of the lower tubular portion. Rigidly attached to the lower tubular portion are steps which are oriented perpendicularly to the tubular portions. In the deployed position, the upper and lower tubular portions of the boat stair device are oriented to provide a gradually sloping stair which may be climbed by an individual in an upright position with use of lower body strength with little or no upper body strength or assistance. Such first embodiment of the present invention is for use with substantially vertical surfaces such as boat hulls and transoms.

An second preferred embodiment of the present invention provides a stair for use on with substantially horizontal surfaces, such as docks and the swim platforms of boats. In the second preferred embodiment of the present invention, the stair device is comprised of upper and lower tubular portions. The upper tubular portion of the second preferred embodiment, however, rests on and is attached to a horizontal surface, such as a swim platform.

DETAILED DESCRIPTION OF THE INVENTION

Figure 1:
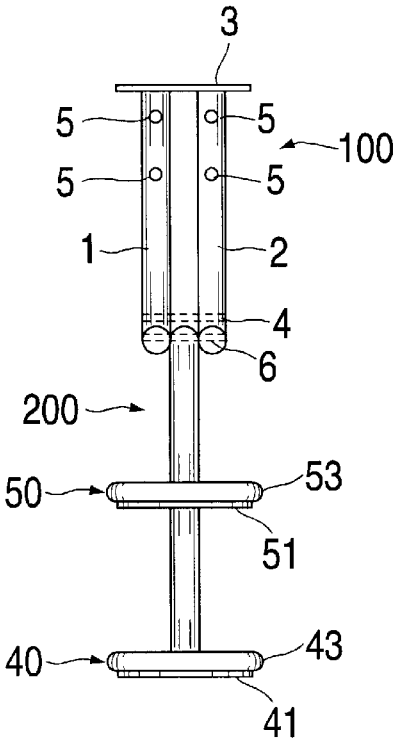
FIG. 1 is a front view of a first preferred embodiment of the stair device of the present invention in its deployed position.
Figure 2A:
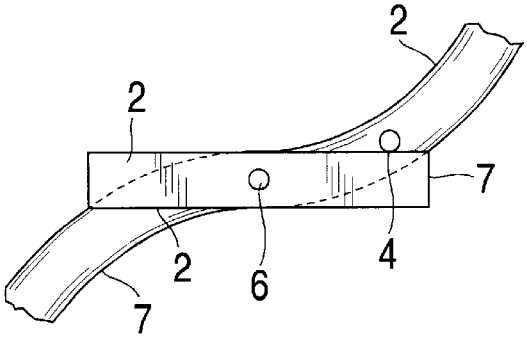
FIG. 2A is a detailed side view of the area of intersection of the upper and lower tubular portions of a first preferred embodiment of the stair device of the present invention in its deployed position.
Figure 2:
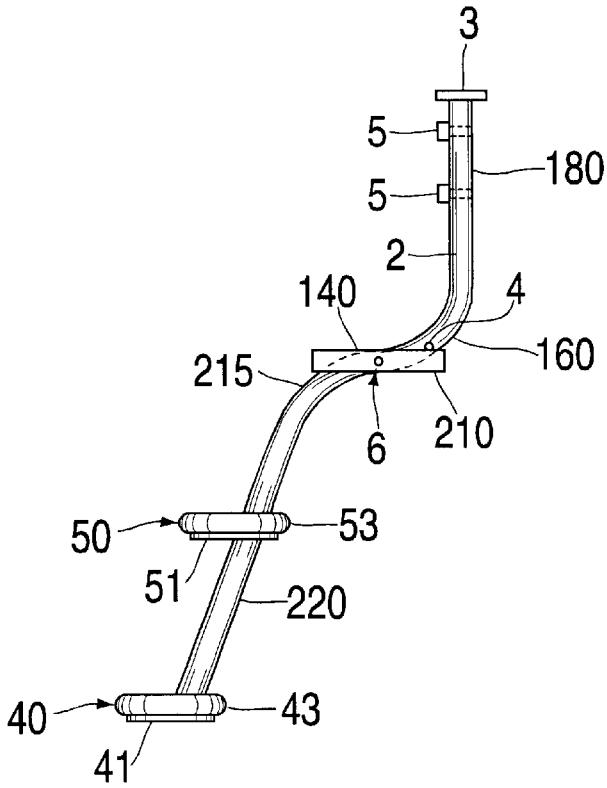
FIG. 2 is a side view of a first preferred embodiment of the stair device of the present invention in its deployed position.
Figure 3:
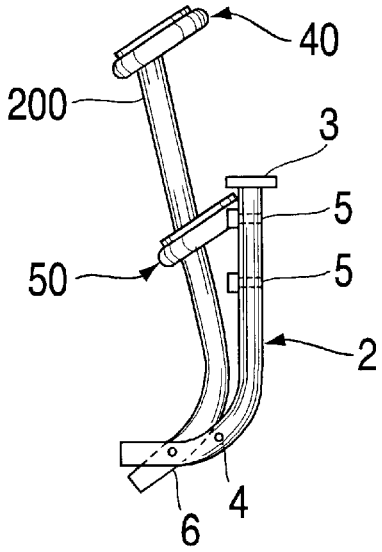
FIG. 3 is a side view of a first preferred embodiment of the stair device of the present invention in its stored position.

Referring first to FIG. 1, a first preferred embodiment of the boat stair device of the present invention is comprised of two tubular sections, one being an upper tubular section 100 and the second being a lower tubular section 200. The stair device is typically attached to the stern of a boat. As shown in FIG. 1, upper tubular section 100 is comprised of two tubes 1 and 2 which extend parallel to each other and which are of identical shape, within reasonable tolerances. As shown in FIG. 2, each of tubes 1 and 2 are comprised of a lower portion 130 (not shown) and 140, respectively, which are substantially horizontal, curved portions 150 (not shown) and 160, respectively, and upper portions 170 (not shown) and 180, respectively, which are substantially vertical. Referring again to FIG. 1, extending between and through tubes 1 and 2 at their lower portions 130 and 140, respectively, is a stop pin 4. Stop pin 4 may attached to tubes 1 and 2 by any one of several mechanisms known in the art, such as welding or by through placement with end lock nuts. Stop pin 4 limits the rotation angle of lower tubular portion 200 and acts as a stop and support for lower tubular portion 200 in both the deployed and stored positions. As shown in FIGS. 1 and 2, lower tubular portion 200 is comprised of a single tube, having a substantially straight upper portion 210, a curved portion 215 and a substantially straight lower portion 220. When in the deployed position, straight upper portion 210 is substantially horizontal and straight lower portion 220 is substantially vertical but slopes slightly forward when the stair device is in its deployed position. Lower tubular portion 200 is pivotally attached to upper tubular portion 100 by use of pivot pin 6 which extends through lower portions 130 and 140 of tubes 1 and 2 and through flat upper portion 210. Pivot pin 6 extends through portions 130 and 140 forward of the location of stop pin 4.

Figure 1A:
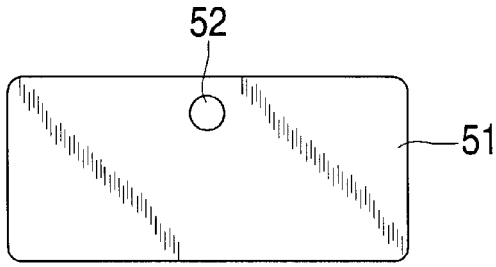
FIG. 1A is a top view of step support plate of a mid-step (50).

The stair device of the first preferred embodiment is further comprised of a plurality of steps. Referring to FIG. 1, steps 40 and 50 are fixedly attached to lower tubular portion 200. Step 40 is attached at the lower end of lower tubular portion 200 and step 50 is attached at approximately the midpoint of lower tubular portion 200. Each of steps 40 and 50 are comprised of a base plate, 41 and 51, respectively, having a substantially rectangular shape. Base plate 51 further contains an opening 52, as seen in FIG. 1A. Opening 52 is sized and shaped such that lower tubular portion 200 may be slid through opening 52 during the manufacturing process. Opening 52 is placed at approximately the transverse midpoint of base plate 51 but is preferably offset such that it lies nearer the back edge of base plate 51. Base plate 51 is fixedly attached at the appropriate position to lower tubular portion 200 by any of a number of mechanisms known in the art. In the preferred embodiment of the present invention, base plate 51 is fusion welded to lower tubular portion 200 at opening 52. Base plate 41 is fixedly attached to the lower end of tubular portion 200 by any of a number of mechanisms known in the art. In the preferred embodiment, base plate 41 is fusion welded to the lower end of lower portion 220.

Referring now to FIG. 1, the stair device is further comprised of an upper cross brace 3, which is substantially rectangular in shape and which is fixedly attached to the upper edges of tubes 1 and 2 by any of a number of mechanisms known in the art. In the preferred embodiment, upper cross brace 3 is fusion welded to the upper edges of tubes 1 and 2. It will be understood that cross brace 3 may be of a size and shape such that it may also serve as an additional step.

Figure 1B:
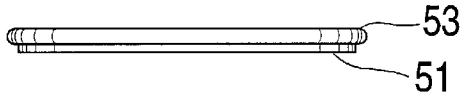
FIG. 1B is a side view of mid-step (50).

As shown in FIG. 1B an upper step layer 53 of substantially the same size and shape as base plate 51 is fixedly attached to the top surface of base plate 51. Upper step layer 53 may be comprised of any non-corrosive, low- or non-skid material, such as teak or high density polyethylene. It will be understood that strips of non-skid adhesive tape may be used as an acceptable alternative to upper step layer 53. It will be further understood that an upper step layer 43 may be fixedly attached to the upper surface of base plate 41, as seen in FIGS. 1 and 2. It will be further understood that an upper step layer 33 (not shown) may be fixedly attached to the upper surface of cross brace 3, so that cross brace 3 may function as an additional step.

Figure 4A:
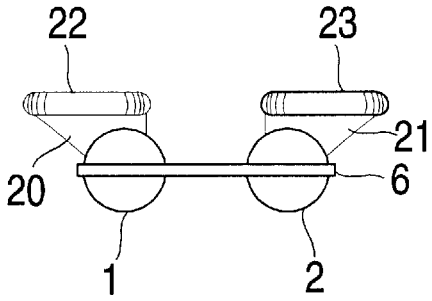
FIG. 4A is a front view of the wing steps attached to the upper tubular portion of a first preferred embodiment of the stair device of the present invention.
Figure 4B:
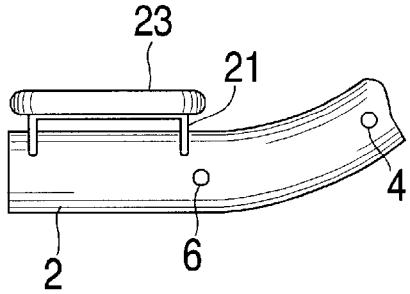
FIG. 4B is a side view of a wing step attached to the upper tubular portion of a first preferred embodiment of the stair device of the present invention

Referring now to FIG. 4A, the stair device of the present invention may be further comprised of left wing step 22 and right wing step 23. Wing steps 22 and 23 are fixedly attached to lower portions 130 and 140 of tubes 1 and 2, respectively, by way of support brackets 20 and 21. Support brackets 20 and 21 are unitary brackets shaped so as to rest upon the upper surface of lower portions 130 and 140 of tubes 1 and 2, respectively, and having a flat portion upon which wing steps 22 and 23 are fixedly attached. Support brackets 20 and 21 are fixedly attached to portions 130 and 140 by any of a number of mechanisms known in the art. In the preferred embodiment of the present invention, support brackets 20 and 21 are fusion welded to portions 130 and 140 respectively. It will be understood that each of wing steps 22 and 23 may be comprised of an upper step pad overlying a step support plate as are steps 40 and 50.

As shown in FIG. 1, the stair device of the present invention may be attached to the hull or transom of a boat or other substantially vertical appropriate surface by way of screws or bolts placed through openings 5 in upper portions 170 and 180 of tubes 1 and 2, respectively. It will be understood that additional openings to accommodate additional bolts or screws may be made in upper portions 170 and 180 as necessary to accomplish a firm attachment of the boat stair device.

The curvature of lower portion 210, upper portion 220, curved portions 150 and 160 and the placement of stop pin 4 are such that, when deployed, the stair device provides a comfortable ascent angle from the lowest step to the topmost step of between about sixty and seventy degrees from the horizontal. Such ascent angle permits one in the water to climb the stair device of the present invention with an upright posture such as one would use when climbing stairs.

Figure 9:
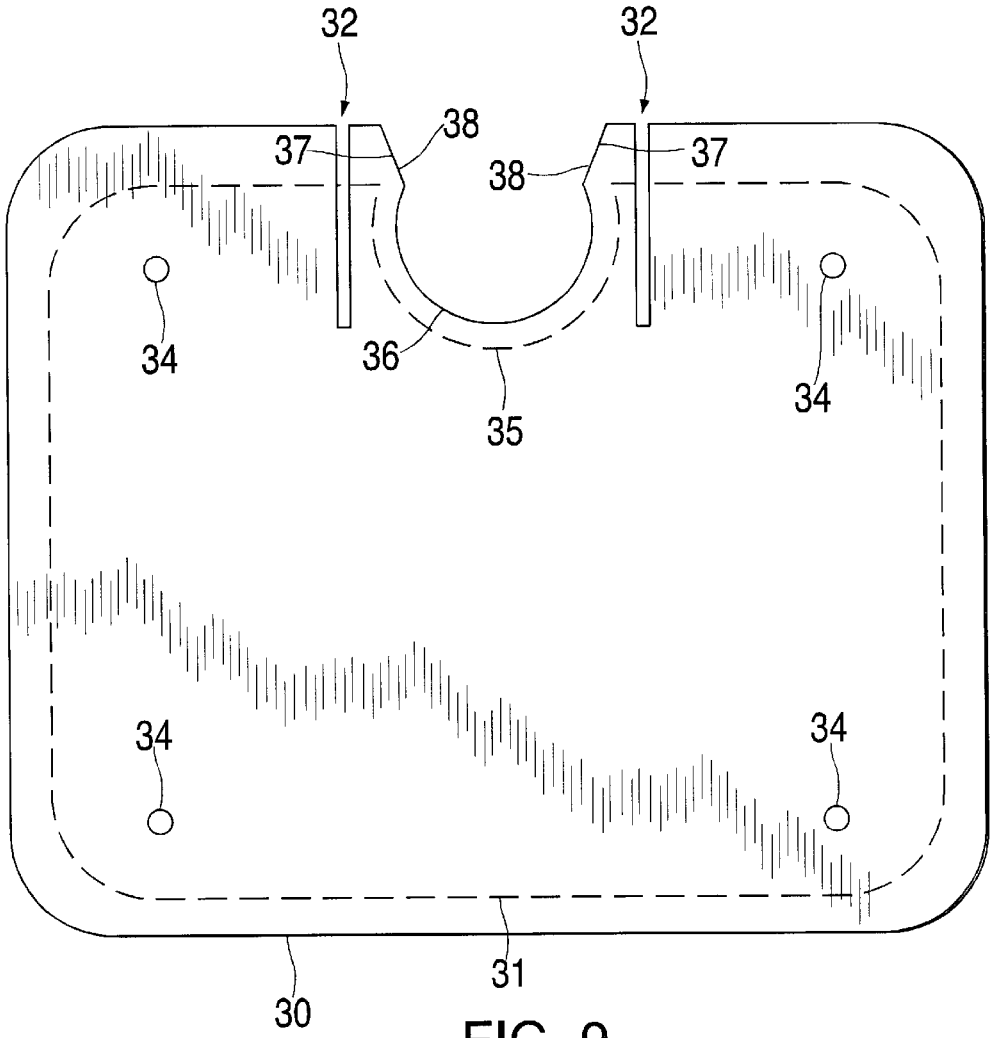
FIG. 9 is a top view of an alternative cross brace (3) of the first preferred embodiment of the stair device of the present invention.

Referring now to FIG. 9, an alternative configuration of cross brace 3 is shown. In this alternative configuration, cross brace 3 further functions as a step and as a means to secure lower tubular portion 200 in the stored position. In this alternative configuration, cross brace 3 is comprised of an upper step layer 30 and a lower step support plate 31, both of which are substantially rectangular. At its forward edge, upper step layer 30 has an inwardly curved portion, a retention portion 33. Retention portion 33 is comprised of a substantially ovoid 36, two lip sections 37 and a flanking section 38. On either side of retention portion 33 are slots 32. Retention portion 33 is sized so as to permit lower tubular portion 200 to pass through flanking section 38, to pass through lip sections 37 upon contraction of slots 32, and to rest within ovoid section 36. At its forward edge, lower step support plate 31 has a cut-out portion 35, such cut-out portion being substantially ovoid in shape and being of greater size than retention portion 33. Upper step layer 30 is placed over lower step support 31 such that retention portion 33 is substantially centered over cut-out portion 35. Upper step layer 30 may be attached to lower step support layer 31 by means of fasteners 34. It will be understood that top step layer 30 should be made of a material which would permit slots 32 to compress and/or expand, such as a high density polyethylene.

Figure 7:
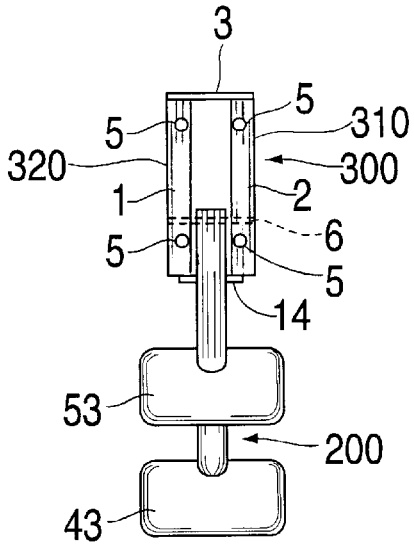
FIG. 7 is a top view of a second preferred embodiment of the stair device of the present invention in its deployed position.
Figure 6:
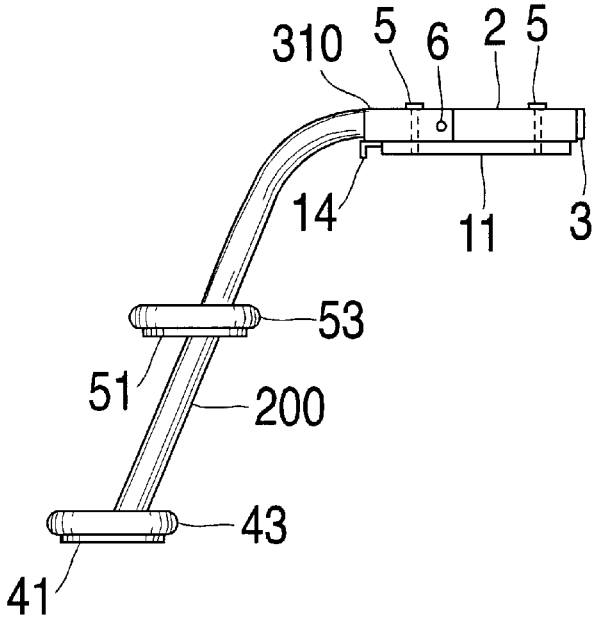
FIG. 6 is a side view of a second preferred embodiment of the stair device of the present invention in its deployed position.

A second preferred embodiment of the stair device of the present invention is best suited for use on swim platforms. Referring now to FIG. 6, a second preferred embodiment of the stair device of the present invention is comprised of a lower tubular portion 200, said lower tubular portion essentially identical in shape to lower tubular potion of the first preferred embodiment. Referring now to FIG. 7, the stair device of the second preferred embodiment is further comprised of an upper tubular portion 300 which is comprised of two tubes 310 and 320 which extend parallel to each other and which are of identical shape, within reasonable tolerances. Lower tubular portion 200 is pivotally attached to upper tubular portion 300 by use of pivot pin 6 which extends through tubes 310 and 320 and through flat upper portion 210. The placement of pivot pin 6 through lower tubular portion 200 is such that lower tubular portion 200 may pivot between tubes 310 and 320 without contacting the surface upon which the stair device is mounted. Pivot pin 6 extends through tubes 310 and 320 at less than one-half the length of tubes 310 and 320 from the front edge of tubes 310 and 320. Across the rear portions of tubes 310 and 320, a cross brace 3 is fixedly attached.

Figure 5A:
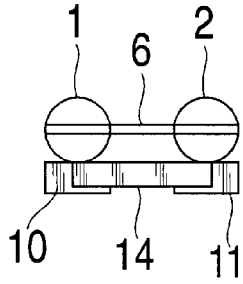
FIG. 5A is a front view of the upper tubular element of a second preferred embodiment of the stair device of the present invention.
Figure 5:
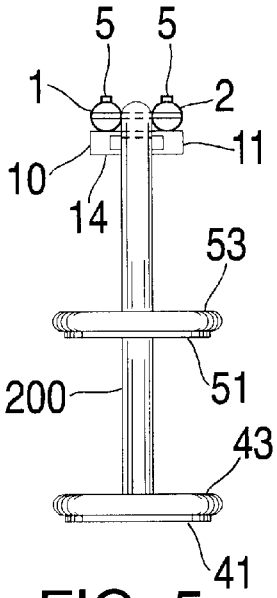
FIG. 5 is a front view of a second preferred embodiment of the stair device of the present invention in its deployed invention.
Figure 6A:
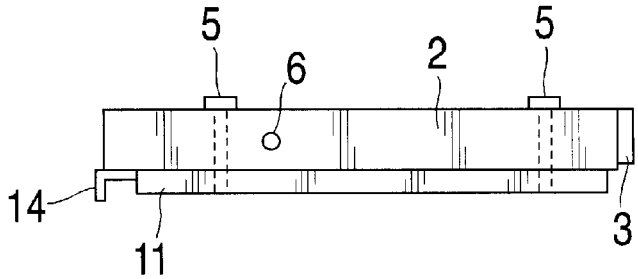
FIG. 6A is a side view of the upper tubular portion of a second preferred embodiment of the stair device of the present invention.
Figure 8:
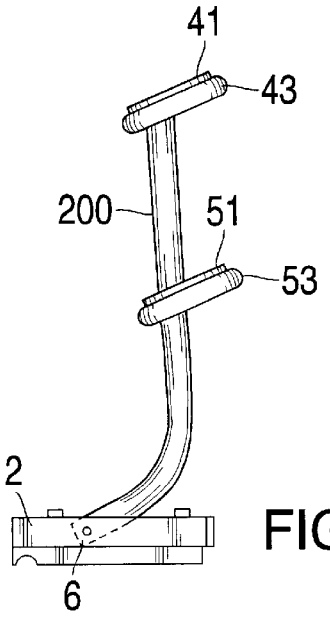
FIG. 8 is a side view of a second preferred embodiment of the stair device of the present invention in its stored position.

The second preferred embodiment of the stair device is mounted to a horizontal or substantially horizontal surface, such as the upper surface of a swim platform, by use of a mounting mechanism shown in FIGS. 5A and 6A. Referring to FIGS. 5A and 6A, the mounting mechanism is comprised of two substantially rectangular spacer elements, one a left spacer element 10 and one a right spacer element 11. Spacer elements 10 and 11 may be fixedly attached to a substantially horizontal surface, such as a swim platform using any of a number of methods known in the art, such as with the use of bolts. Between the front ends of spacer elements 10 and 11 is attached a substantially rectangular stop pin 14. Stop pin 14 acts to limit the rotation of lower tubular portion 200 and lower tubular portion 200 rests upon stop pin 14 when in the deployed position. It will be understood that stop pin 14 could alternatively be any acceptable shape, such as tubular or flat. Tubes 310 and 320 are rigidly attached to left spacer element 10 and right spacer element 11, respectively, by mounting fasteners 5. It will be understood that fasteners 5 may pass through openings in spacer elements 10 and 11 and into the surface on which the stair device is to be mounted.

It will be understood that the material of construction of the tubular portions, pins, base plates and brackets of the stair device of the present invention may be any material with substantial resistance to corrosion in environments of water, salt water and sunlight, such as stainless steel or polished aluminum. In the preferred embodiments of the invention, such components of the stair device are constructed of 304 stainless steel. In the preferred embodiments of the present invention, all tubular components are constructed of thin-walled 304 stainless steel tubing having a wall thickness of about eighty one-thousandths of an inch. It will be understood that all components should be made of marine grade materials which can reasonably withstand exposure to water, sunlight and/or saltwater.

We claim:

1. A stair device comprising:

an upper tubular portion, said upper tubular portion comprised of two tubes substantially identical in shape and parallel to each other, each of said tubes having a substantially vertical upper portion, a curved portion and a substantially horizontal lower portion;

said upper tubular portion further comprising a stop pin (4) mounted between each of said curved portions of each of said tubes;

a lower tubular portion comprised of a single tube having a substantially straight upper portion, a curved portion, and a substantially straight lower portion, said upper portion of said lower tubular portion substantially perpendicular to said lower portion of said lower tubular portion;

said lower tubular portion further comprised of a plurality of steps, each of said steps comprised of a substantially flat plate rigidly attached to said lower tubular portion and substantially perpendicular to said lower tubular portion; and said lower tubular portion pivotally attached to said upper tubular portion by means of a pivot pin (6) passing through said substantially horizontal lower portion of said tubes of said upper tubular portion, and through said substantially straight upper portion of said lower tubular portion.

2. A stair device comprising:

an upper tubular portion, said upper tubular portion comprised of two tubes substantially identical in shape and parallel to each other;

a lower tubular portion comprised of a single tube having a substantially straight upper portion, a curved portion, and a substantially straight lower portion, said upper portion of said lower tubular portion substantially perpendicular to said lower portion of said lower tubular portion;

said lower tubular portion further comprised of a plurality of steps, each of said steps comprised of a substantially flat plate rigidly attached to said lower tubular portion and substantially perpendicular to said lower tubular portion;

said lower tubular portion pivotally attached to upper tubular portion by means of a pivot pin (6) passing through said tubes of said upper tubular portion and through said substantially straight upper portion of said lower tubular portion; and a mounting means comprised of two substantially rectangular spacer elements, one of each said spacer elements underlying one of each said tubes of said upper tubular portion;

said mounting means further comprised of a stop pin (14) mounted perpendicular to and across front edges of said spacer elements.

* * * * *